US007570143B2

(12) United States Patent
Adunka et al.

(10) Patent No.: US 7,570,143 B2
(45) Date of Patent: Aug. 4, 2009

(54) METHOD FOR WINDING A COIL, A WINDING FORM, AND A COIL

(75) Inventors: Robert Adunka, Sulzbach-Rosenberg (DE); Norbert Zimmermann, Sulzbach-Rosenberg (DE); Werner Übler, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 14 days.

(21) Appl. No.: 11/714,176

(22) Filed: Mar. 6, 2007

(65) Prior Publication Data

US 2007/0229207 A1 Oct. 4, 2007

(30) Foreign Application Priority Data

Mar. 6, 2006 (EP) ..... 06004459

(51) Int. Cl.
*H01F 27/30* (2006.01)

(52) U.S. Cl. ..... 336/198

(58) Field of Classification Search ..... 336/65, 336/198, 206–208; 29/602.1, 605
See application file for complete search history.

(56) References Cited

U.S. PATENT DOCUMENTS 5,963,120 A * 10/1999 Zaviska ..... 336/208
6,031,443 A * 2/2000 Larsen ..... 336/192
2002/0153986 A1* 10/2002 Ushio et al. ..... 336/198
2005/0040725 A1 2/2005 Suzuki
2007/0257760 A1* 11/2007 Saito et al. ..... 336/178

FOREIGN PATENT DOCUMENTS

| | | |
|---|---|---|
| EP | 0 070 752 | 6/1982 |
| JP | 61182209 | 8/1986 |
| JP | 2003318019 | 11/2003 |

* cited by examiner

*Primary Examiner*—Tuyen Nguyen
(74) *Attorney, Agent, or Firm*—Harness, Dickey & Pierce PLC

(57) ABSTRACT

A method, in at least one embodiment, is disclosed for winding a coil onto a winding form including a first part, a second part, and a step between the first part and the second part, the first part having a relatively larger diameter than the second part. In an embodiment, the method includes receiving a conductor wire at a groove-like depression in the first part; bringing the conductor wire in the groove-like depression onto the second part; winding on the second part using the conductor wire; and winding on the first part using the conductor wire. Embodiments of a winding form and a coil are also disclosed.

26 Claims, 3 Drawing Sheets

METHOD FOR WINDING A COIL, A WINDING FORM, AND A COIL

PRIORITY STATEMENT

The present application hereby claims priority under 35 U.S.C. § 119 on European patent application number EP06004459 filed Mar. 6, 2006, the entire contents of which is hereby incorporated herein by reference.

FIELD

Embodiments of the present application generally relate to methods for winding coils onto a winding form comprising, for example a first part, a second part, and a step between the first part and the second part, the first part having a larger diameter than the second part. Furthermore, embodiments of the present application generally relate to winding forms of this kind, and/or to coils wound on such a winding form.

BACKGROUND ART

Two methods for winding magnet coils are known. In the "mandrel method", the winding form is first placed onto a spike or mandrel, which is then rotated together with the winding form so that conductor wire is wound around the winding form from the supply of conductor wire. In the "winding with flyer" method, the winding form is held stationary whereas the supply of conductor wire is rotated around the winding form, with the effect that the conductor wire is wound around the winding form.

Regardless which one of these methods is used, winding of a coil on a winding form, the diameter of which changes stepwise across the winding form, has to be started at the position where the winding form diameter is at smallest, and then the coil must be wound, layer for layer, until the desired winding height has been achieved in order to ensure a smooth and controllable winding. Otherwise, an effect as shown in the series of FIGS. 1 to 3 may occur.

A prior art winding form comprises a first part 18 and a second part 10, and a step 15 between them. The first part 18 has a larger diameter than the second part 10, and both are limited by respective end walls 11, 12. If winding of such a winding form is started on the first part 18, the conductor wire 13 can be wound, starting from the left hand side of FIG. 1, with no problem only until the step 15. When the winding goes beyond the step 15 to the right (FIG. 2), however, the conductor wire 13 that is being wound on the side 10 of the winding form having a smaller diameter pulls down some of the conductor wire 13 already wound on the other side 18 of the step 15. Since the winding is usually performed so that the conductor wire 13 is under tension, some conductor wire on the side 18 with a larger diameter slips down almost unavoidably. This may easily result in a tuft of conductor wire at the end position L of the step 15, making the resulting coil useless.

US 2005/0040725 A1 discloses a bobbin that comprises a hollow-cylindrical middle section and two lateral hollow-cylindrical body sections. The middle section has its diameter diminished compared to the two lateral body section thus forming an annular recess which allows a magnet wire to be wound with an additional number of turns around the bobbin.

The English abstract of EP 0 070 752 discloses a security transformer, a first winding of which is located within a second winding and the integral bobbin of which has a cylindrical portion about which the internal winding is wound and which is extended, at each of the axial ends, by cylindrical portions of larger section forming supports of an insulating foll surrounding the internal winding and whereabout the external winding is wound, the non-insulated connection conductors of the internal winding crossing a cylindrical end portion. Grooves are arranged within a cylindrical end portion, extending along a spiral path prolonging the spiral of the internal winding, and devices are provided for applying these non-insulated conductors into the bottoms of the grooves.

To avoid slipping of the conductor wire at the step, all manufacturers, if willing to wind a coil on a winding form whose diameter changes across the winding form over a step, need to start the winding from the part of the winding form that has the smallest diameter.

SUMMARY

The need to always start the winding from the part of the winding form that has the smallest diameter has been considered by the present inventors to be an undesired limitation, since it may easily happen that, due to constructional reasons, the winding should be started from the other part, where the winding form diameter is not at smallest. This may be the case if there, in a subsequent assembling step, for example, is a need to connect the coil through terminals located at the bottom, the lower part of the winding form having the larger diameter, for example.

In at least one embodiment of the invention, an improved method for winding a coil onto a winding form is provided. In at least one embodiment, the method includes a first part, a second part and a step between the first and the second part, the diameter of the first part being relatively larger than that of the second part.

The method, in at least one embodiment, can include receiving a conductor wire at a groove-like depression in the first part, bringing the conductor wire in the groove-like depression onto the second part, winding on the second part using the conductor wire, and after having wound on the second part, winding on the first part using the conductor wire. Since on the first part it has not been wound before bringing the conductor wire in the groove-like depression over the step onto the second part, the bringing can be carried out conveniently. Thus, winding on the second part first is enabled even though the conductor wire was introduced into the winding form at the second part or through the side wall of the second part.

Because the conductor wire runs in the groove-like depression from its entering point at the first part to the second part, it will run below the first layer that will be wound onto the first part and does not cause non-circular winding nor make the winding to raise or curl. These improvements in the winding of at least one embodiment may thus reduce the probability of a flashover to which usually damages in the electric insulation of the conductor wire may lead. Furthermore, improvements in the winding of at least one embodiment may help in avoiding imbalance problems, if the mandrel method is being used.

Because the conductor wire runs in the groove-like depression of in at least one embodiment, it thus may have a preferred position which it easily takes.

The groove-like depression may have the form of a spiral in at least one embodiment, which enables bringing the conductor wire in the groove-like depression to the second part by relative rotation between the winding form and the supply of conductor wire and simultaneous relative axial displacement between the winding form and the supply of conductor wire.

The groove-like depression may, in at least one embodiment, have the form of a line that descends towards surface of the second part, which enables using of a relatively simple linear movement in the winding arrangement.

On one hand, to enable an economic manufacture, the winding form of at least one embodiment may be made using injection moulding so that the groove-like depression is formed not to have an undercut.

On the other hand, if the winding form of at least one embodiment is so formed that the groove-like depression has an undercut, the sensitivity of a ready coil against flashovers may be improved.

BRIEF DESCRIPTION OF THE DRAWINGS

In the following, an embodiment of the invention is discussed in more detail with reference to FIGS. 4 to 6 in the accompanying drawings, of which.

Same reference symbols refer to similar structural elements throughout the Figures.

DETAILED DESCRIPTION OF THE EXAMPLE EMBODIMENTS

Figure 1:
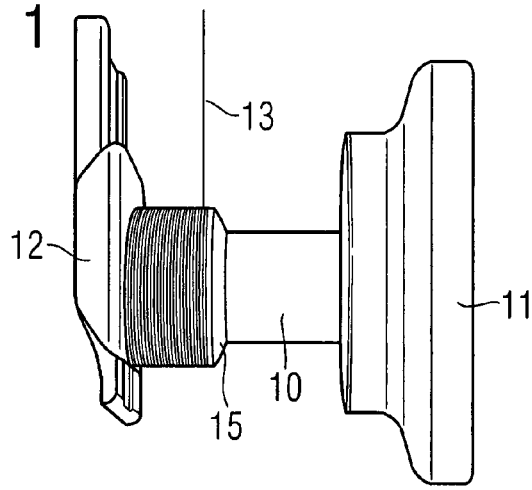
FIGS. 1, 2 and 3 illustrate the problem that tends to occur with prior art coil winding methods when the conductor wire is wound over a step under tension.
Figure 2:
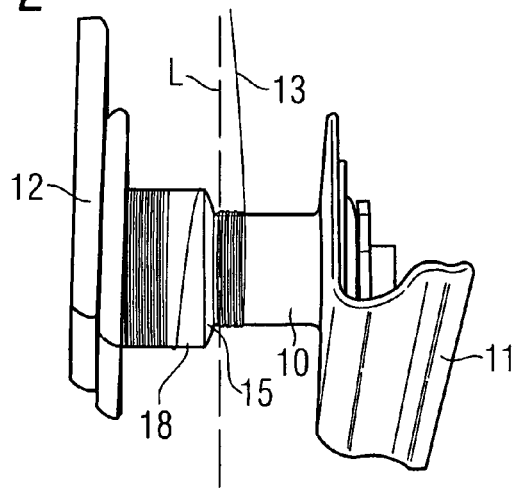
Figure 3:
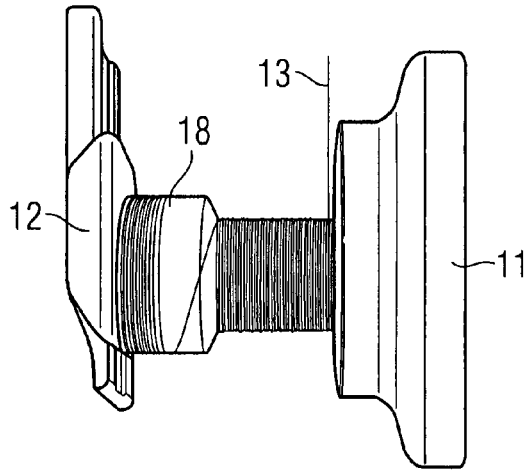

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described.

Figure 4:
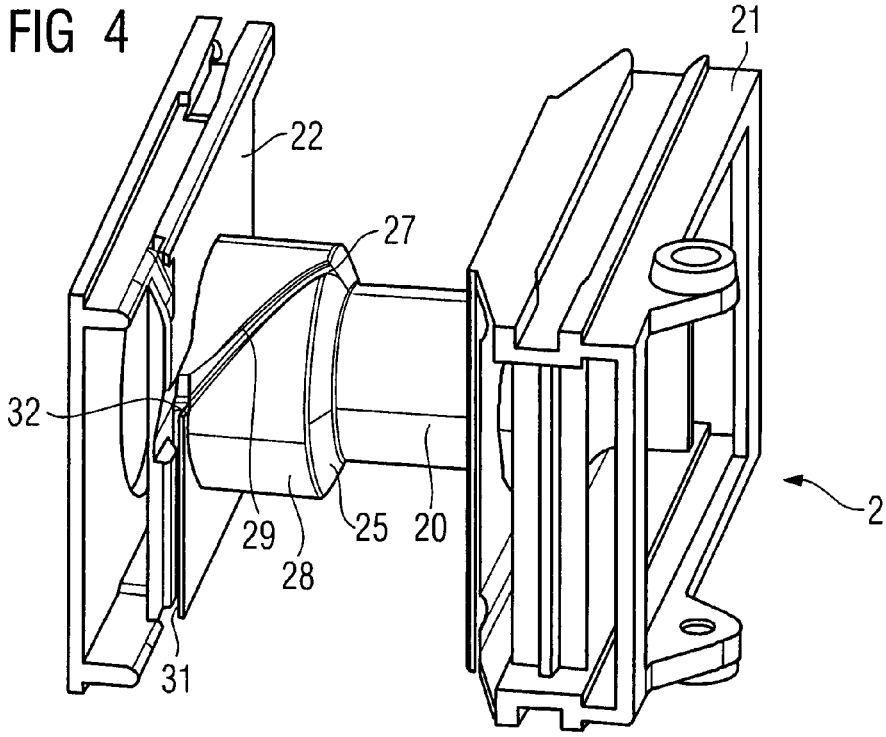
FIG. 4 illustrates an embodiment of a winding form.

FIG. 4 illustrates a winding form 2 of an example embodiment. The winding form 2 includes a first part 28 and a second part 20, the part of the winding form 2 including the first part 28 and the second part preferably being consisting of one part only. The first part 28 and the second part 20 are both preferably cylindrical surfaces which may be smooth or rough. The winding form 2 is preferably made of plastic, especially using injection moulding.

The first part 28 has a larger diameter than the second part 20. There is a step 25 between said first part 28 and said second part 20 separating the first part 28 from the second part 20.

According to one aspect of an embodiment of the invention, the winding form 2 includes a groove-like depression 29 in the first part 28, the groove-like depression 29 leading to the second part 20, preferably through a run-out 27 leading to the second part 20 through the step 25.

The winding form 2 may further include end walls 22, 21 limiting the winding area of the first part 20 and the second part 28. In particular, the conductor wire may be brought into the groove-like depression 29 via end wall 22. Behind or in the end wall 22 there is preferably a protrusion 32 (see FIG. 5) that has been adapted to guide a conductor wire from the wire conduct 31 into the groove-like depression 29. In order to avoid damaging the electric insulation of the conductor wire, the entering area 39 around the protrusion may be adapted to have a bending radius, the magnitude of which preferably depends on the quality and dimensioning of the conductor wire and of the winding form 2.

Figure 5:
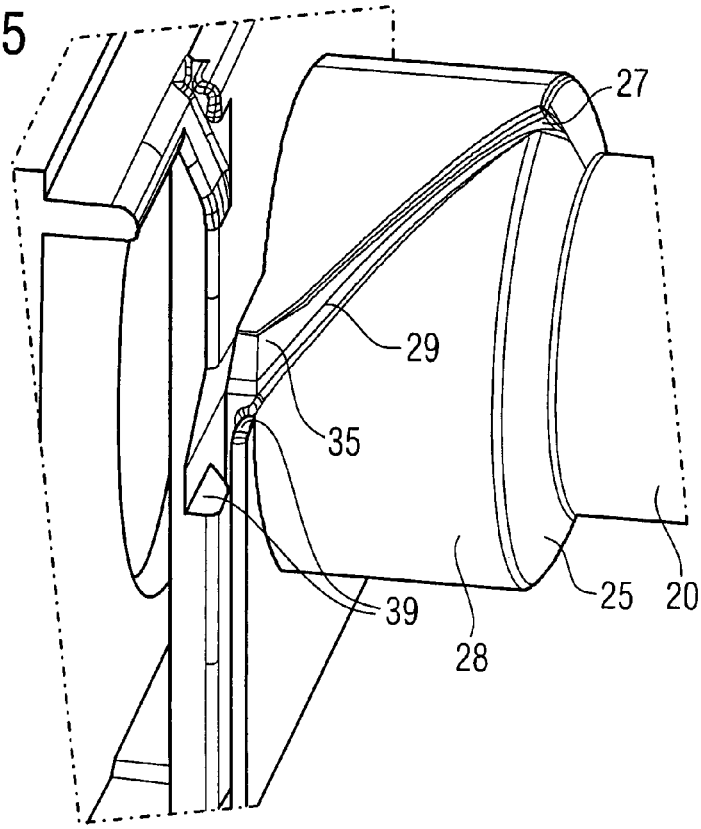
FIG. 5 shows a closer view of the groove-like depression in an embodiment of the winding form.

FIG. 5 shows a closer view of the groove-like depression 29 in the winding form 2. In order to enable the plastic parts of the winding form 2 to be made using injection moulding, the groove-like depression 29 may have a form having no undercut. Particularly advantageous is, if the whole groove-like depression 29 can be made in one part of the mold, such as in one half.

The groove-like depression 29 may, preferably at least in the area of the step 25 or the run-out 27, have a rectangular cross-section. Furthermore, the groove-like depression 29 may in the area of the step 25 or the run-out 27 be as deep as possible. If the winding form 2 has been made using injection moulding, these aspects mean that the hand-over point of the run-out 27 should, in relation to part or half of the injection mould in which the groove-like depression 29 is formed, be at the location of the highest apex or vertex of the first part 28.

In an ideal case, if the groove-like depression 29 has a shape that comprises a crest 35 that, when seen from below (such as from the direction of the arrow in FIG. 5), resembles a protrusion, the conductor wire can slip next to it so that the creepage distance and the sparking distance in air of the conductor wire in the groove-like depression 29 to the next layer can be increased.

The end wall 22 may form a flange, which, in order to make it easier to introduce the conductor wire into the groove-like depression 29, may further be hollowed out around the entering area 39 so that the conductor wire can be drawn from the entering area 39 into the groove-like depression 29 in a straight line. The effect of the form of the entering area 39 and possibly also that of the crest 35 is that the conductor wire will automatically find its way from the conduct 31 of the end wall 22 into the groove-like depression 29.

The example of FIG. 5 shows a groove-like depression 29 that has the form of a spiral. Alternatively or in combination to this, it may further be possible to have the groove-like depression 29 as a line that descends towards the surface of the second part 28.

Figure 6:
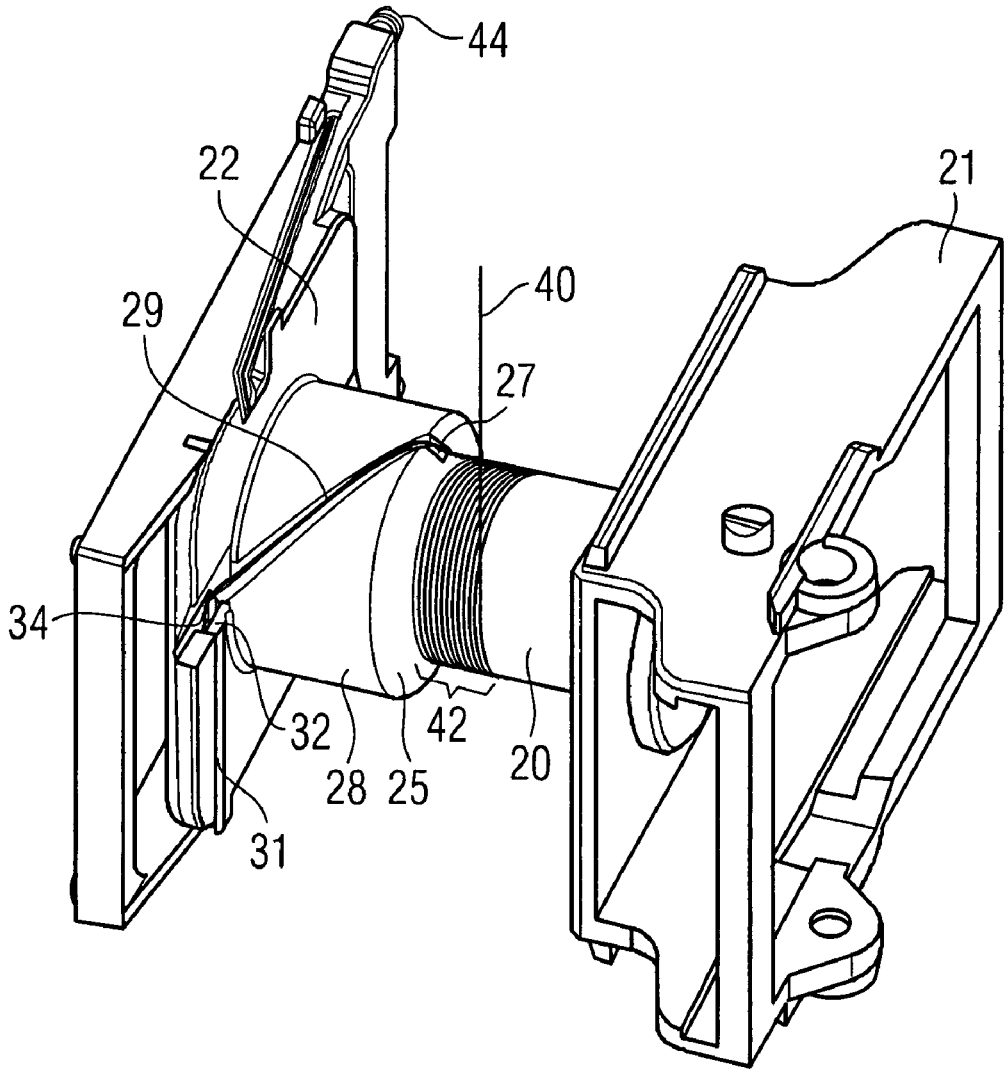
FIG. 6 illustrates how an embodiment of the winding is initiated.

FIG. 6 illustrates how the winding of a coil is initiated. A winding form 2 of the above kind receives conductor wire 40 at the groove-like depression 29 in the first part 28. Conductor wire 40 is then brought in the groove-like depression 29 onto the second part 20 on which it is then wound, after which the conductor wire 40 is wound on the first part 28. Because the conductor wire 40 runs in the groove-like depression 29 from the entering point i.e. protrusion 32 to the second part 20, it will be below the first layer that will be wound onto the first part 28 and does not cause non-circular winding nor make the winding to raise or curl.

The conductor wire 40 includes a heart of conducting material, preferably of metal, such as copper. The heart of conducting material is preferably coated with a material having a poorer conductivity, especially with a material that is capable to provide adequate electrical insulation. In the selection of the coating material, preferably a material with electrical resistivity of at least $10^{11}$ Ωm is selected, the material preferably having dielectric strength of at least 10 kV/mm. The preferred coating material is modified polyurethane.

According to one aspect of an embodiment of the invention, the conductor wire 40 is brought into the groove-like depression 29 from a wire conduct 31 that leads to terminal 44, to which an end of the conductor wire 40 can be connected. To make it easier for the conductor wire 40 to change its direction from wire conduct 31 to the groove-like depression 29, a protrusion 32 adapted to guide the conductor wire 40 may be used. The protrusion 32 may in particular prevent the conductor wire 40 from slipping into the first winding area, i.e. onto the first part 28.

The conductor wire 40 may be brought from the groove-like depression 29 to the second part 20 through a run-out 27 in the step 25.

If the groove-like depression 29 has the shape of a spiral, the step of bringing the conductor wire 40 in the groove-like depression 29 onto the second part 20 can be performed by relative rotation between the winding form 2 and the supply of conductor wire (not shown in FIG. 6) and simultaneous relative axial displacement between the winding form 2 and the supply of conductor wire. In particular the relative rotation can be achieved by rotating the winding form 2, or in addition to or instead of this, by rotating the supply of conductor wire. The relative axial displacement can be performed by moving the winding form 2, or in addition of instead of, by moving the supply of conductor wire.

If the groove-like depression 29 has the shape of a line that descends towards the surface of the second part 28, step of bringing the conductor wire in the groove-like depression 29 onto the second part 20 can be performed by holding the winding form 2 radially in place relative to the conductor wire and at the same relatively displacing the winding form 2 and the conductor wire from each other. In particular, the relative axial displacement can be performed by moving the winding form 2, or in addition of instead of, by moving the supply of conductor wire.

A thus wound coil includes winding form 2 of the above kind and conductor wire 40 wound around the winding form 2. Both ends of the conductor wire 40 may now end at respective terminals 40 in or behind the respective end wall 22.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for winding a coil onto a winding form including a first part, a second part, and a step between the first part and the second part, the step being tapered between the first part and the second part, the first part including a relatively larger diameter than the second part, the method comprising:

receiving a conductor wire at a groove-like depression in the first part;

bringing the conductor wire in the groove-like depression on to the second part;

winding on the second part using the conductor wire; and winding on the first part, after having wound on the second part, using the conductor wire.

2. A method according to claim 1, wherein the conductor wire is brought from the groove-like depression onto the second part through a run-out in the step.

3. A method according to claim 1, wherein the conductor wire is brought into the groove-like depression from a conduct through an entering area, at least one of automatically and in a straight line.

4. A method according to claim 1, wherein the first part and the second part are both limited by respective end walls.

5. A method according to claim 1, wherein the groove-like depression has the form of a spiral.

6. A method according to claim 5, wherein the bringing of the conductor wire in the groove-like depression to the second part is performed by relative rotation between the winding form and the supply of conductor wire and simultaneous relative axial displacement between the winding form and the supply of conductor wire.

7. A method according to 6, wherein the relative rotation winding is achieved by rotating the winding form.

8. A method according to 6 wherein the relative rotation winding is achieved by rotating the supply of conductor wire.

9. A method according to claim 1, wherein the groove-like depression has the form of a line that descends towards surface of the second part.

10. A method according to claim 9, wherein the bringing of the conductor wire in the groove-like depression to the second part is performed by holding the winding form radially in place relative to the conductor wire and at the same relatively displacing the winding form and the conductor wire from each other.

11. A method according to claim 6, wherein the relative axial displacement is performed by moving the winding form.

12. A method according to claim 6, wherein the relative axial displacement is achieved by moving the supply of conductor wire.

13. A winding form, comprising:

a first part for winding;

a second part for winding;

a step between said first part and said second part, the step being tapered between the first part and the second part, the diameter of the first part being relatively larger than that of the second part; and a groove-like depression in the first part, the groove-like depression leading to the second part.

14. A winding form according to claim 13, wherein said groove-like depression forms a run-out leading to the second part through said step.

15. A winding form according to claim 13, further comprising:

a conduct that leads through an entering area to said groove-like depression.

16. A winding form according to claim 13, wherein said first part and said second part are both limited by respective end walls.

17. A winding form according to claim 13, wherein said groove-like depression has the form of a spiral.

18. A winding form according to claim 13, wherein said groove-like depression has the form of a line that descends toward a surface of the second part.

19. A winding form according to claim 13, wherein the winding form is a winding form made using injection moulding so that the groove-like depression is formed not to have an undercut.

20. A winding form according to claim 13, wherein the groove-like depression forms an undercut.

21. A coil, comprising:

a winding form according to claim 13; and conductor wire wound around said winding form, wherein the conductor wire enters the second part via the groove-like depression and is wound on the second part prior winding on the first part.

22. A coil according to claim 21, wherein said first part and said second part are both limited by respective end walls and wherein both ends of said conductor wire end at respective terminals at least one of in and behind the respective end wall.

23. A method according to claim 2, wherein the conductor wire is brought into the groove-like depression from a conduct through an entering area, at least one of automatically and in a straight line.

24. A method according to 7, wherein the relative rotation winding is achieved by rotating the supply of conductor wire.

25. A winding form according to claim 15, wherein the conduct leads through the entering area to said groove-like depression in a straight line.

26. A winding form according to claim 14, further comprising: a conduct that leads through an entering area to said groove-like depression.

* * * * *